US006597558B1

(12) United States Patent
Luetzow et al.

(10) Patent No.: US 6,597,558 B1
(45) Date of Patent: Jul. 22, 2003

(54) SOLENOID SYSTEM

(75) Inventors: Edwin J. Luetzow, Brookings, SD (US); Richard L. Luetzow, Brookings, SD (US)

(73) Assignee: MTR, Inc., Brookings, SD (US)

( * ) Notice: Subject to any disclaimer, the term of this patent is extended or adjusted under 35 U.S.C. 154(b) by 0 days.

(21) Appl. No.: 09/559,680

(22) Filed: Apr. 27, 2000

(51) Int. Cl.[7] ..... H01H 1/12

(52) U.S. Cl. ..... 361/206; 335/260; 248/200

(58) Field of Search ..... 361/160, 206, 361/142, 166; 335/260, 126; 24/455; 248/316.1, 200

(56) References Cited

U.S. PATENT DOCUMENTS

| | | | | | |
|---|---|---|---|---|---|
| 3,131,331 | A | * | 4/1964 | Ray | 361/142 |
| 3,215,902 | A | * | 11/1965 | Foley et al. | 361/142 |
| 3,384,787 | A | * | 5/1968 | Schwartz | 361/142 |
| 3,643,194 | A | * | 2/1972 | Atherton | 335/260 |
| 3,870,120 | A | * | 3/1975 | Blinkilde | 180/269 |
| 4,213,108 | A | * | 7/1980 | Gross | 335/131 |
| 4,644,179 | A | * | 2/1987 | Pointout et al. | 335/126 |
| 6,049,263 | A | * | 4/2000 | Vilou | 290/38 R |

* cited by examiner

*Primary Examiner*—Kim Huynh
(74) *Attorney, Agent, or Firm*—Hugh D. Jaeger

(57) ABSTRACT

A solenoid assembly including, in order, a circuit breaker side plate, a solenoid, a clamp bracket, and a bridge diode rectifier assembly, all which mechanically and electrically and engage into a precise configuration.

8 Claims, 4 Drawing Sheets

SOLENOID SYSTEM

CROSS REFERENCES TO CO-PENDING APPLICATIONS

None.

BACKGROUND OF THE INVENTION

1. Field of the Invention

The present invention is for a solenoid system, and more particularly, pertains to a mechanical and electrical package of a circuit breaker side plate, a solenoid, a clamp bracket, and a bridge diode rectifier assembly within the clamp bracket.

2. Description of the Prior Art

Prior art solenoid systems have been a collection of components which do not realistically mechanically engage with each other and consist of components which are placed together in a kluge configuration.

The present invention overcomes disadvantages of prior art solenoid systems by providing a compact mechanical and electrical configuration of a circuit breaker side plate, a solenoid, a clamp bracket, and a bridge diode rectifier assembly within the clamp bracket.

SUMMARY OF THE INVENTION

The general purpose of the present invention is to provide a solenoid system which is mechanically and electrically compact.

According to one embodiment of the present invention, there is provided, in order, a circuit breaker side plate, a solenoid, a clamp bracket over the solenoid, and a bridge diode rectifier assembly within an enclosure of the clamp bracket.

Significant aspects and features of the present invention include a solenoid system which is mechanically and electrically compact and efficient.

Having thus described embodiments of the present invention, it is one object of the present invention to provide a solenoid system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
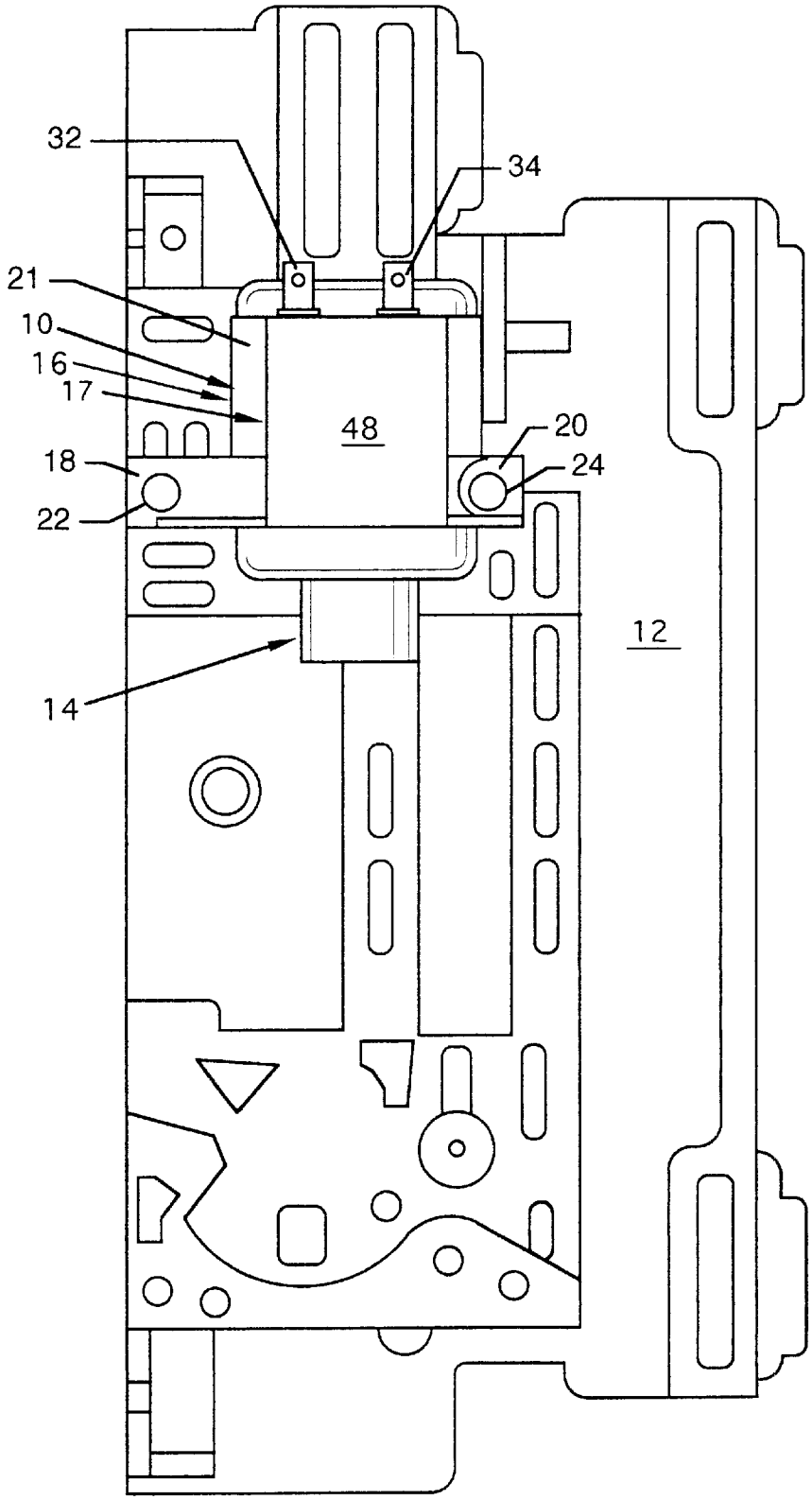
FIG. 1 illustrates a top view of the solenoid system, the present invention.

FIG. 1 illustrates a top view of a solenoid system 10, including a circuit breaker side plate 12, a solenoid 14, and a clamp bracket 16 including mounting tabs 18 and 20 with holes 22 and 24. A cover 48, illustrated in FIG. 1, extends over the four walls 49*a*–49*d* of the clamp bracket 16 illustrated in FIG. 2.

Figure 2:
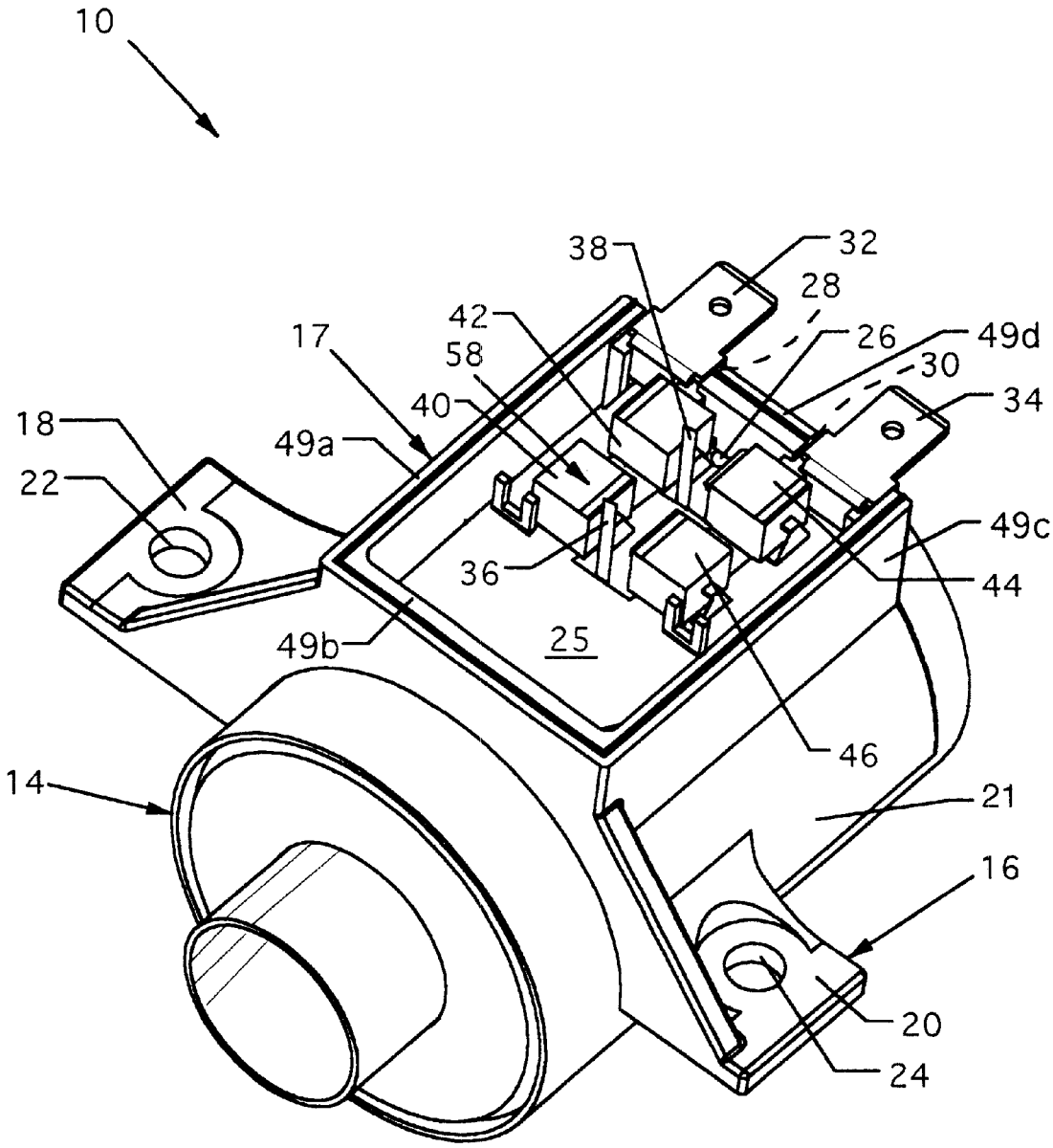
FIG. 2 illustrates an isometric view of the solenoid system.
Figure 3:
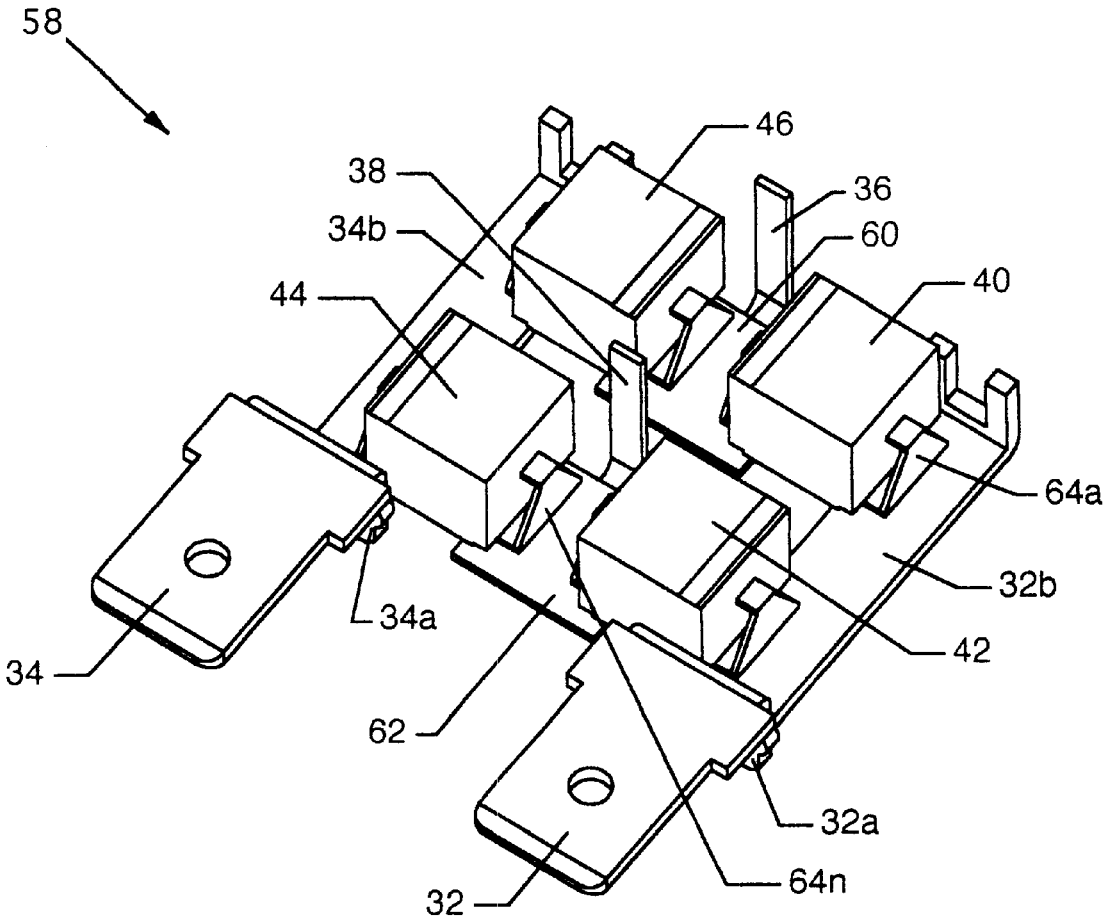
FIG. 3 illustrates an isometric view of a bridge diode rectifier assembly; and, FIG. 4 illustrates an isometric view of the solenoid.

FIG. 2 illustrates an isometric view of the solenoid system 10. A geometrically configured clamp bracket 16 includes walls 49*a*–49*d* defining a greater part of an enclosure 17 for the containment of and the mounting of a bridge diode rectifier assembly 58 and also includes a body 21 which is yoke-shaped and which conforms to the outer circumference of the solenoid 14. The clamp bracket 16 secures over and about the solenoid 14 to fasten the solenoid 14 to the circuit breaker side plate 12, as shown in FIG. 1. Terminal indentations 28 and 30 are located on the top edge of wall 49*d* for passage of the terminals 32 and 34 beneath cover 48 (FIG. 1) and from the interior of the enclosure 17. Terminals 32 and 34, diode solder terminals 36 and 38, diodes 40, 42, 44 and 46, and other members, as illustrated in FIG. 3, comprise the bridge diode rectifier assembly 58. A geometrically configured hole 26 located adjacent to wall 49*d* and in the bottom surface 25 of the enclosure 17 accommodates wires 52 and 54, shown in FIG. 4. The cover 48 is not illustrated in FIG. 2 for purposes of clarity.

FIG. 3 illustrates an isometric view of the bridge diode rectifier assembly 58, where all numerals mentioned previously correspond to those elements previously described. Terminals 32 and 34 also extend downwardly and then outwardly, such as shown by downwardly directed extensions 32*a* and 34*a* and by outwardly directed extensions 32*b* and 34*b* extending from the downwardly directed extensions 32*a* and 34*a*. The outwardly directed extensions 32*b* and 34*b* are utilized for mounting and soldered electrical connection with the respective outboard planar connection tab leads 64*a*–64*n* of the diode pair 40 and 42 and diode pair 44 and 46, respectively. Pad 60 aligns between and connects diodes 40 and 46, and pad 62 aligns between and connects diodes 42 and 44. Respectively, inboard planar connection tab leads 64*a*–64*n* extend from the diode pair 40 and 46 and the diode pair 42 and 44 to the pads 60 and 62 for mounting of and for soldered electrical connection of the diodes 40, 42, 44 and 46. Pads 60 and 62 have solder terminals 36 and 38, respectively, for direct current connection, extending vertically therefrom, and are utilized for mounting and electrical connection with the respective inboard planar connection tab leads 64*a*–64*n* connected to the inboard sides of the diodes 40, 42, 44 and 46. Solder terminals 36 and 38 connect to the wires 52 and 54 of the solenoid 14.

Figure 4:
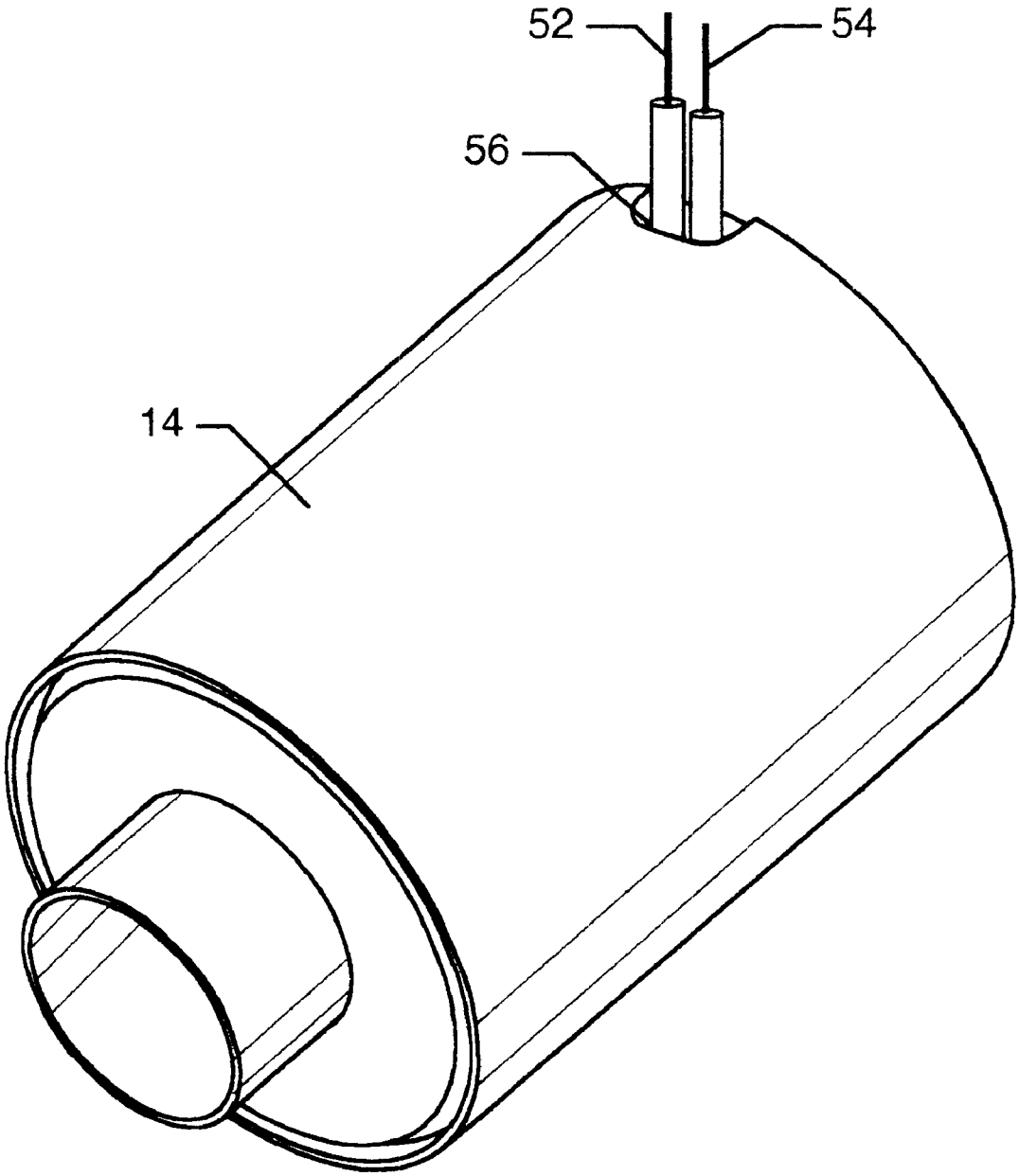

FIG. 4 illustrates an isometric view of the solenoid system 10 without the clamp bracket 16 or the circuit breaker side plate 12. Illustrated in particular is hole 56 and wires 52 and 54 extending through the hole 56.

MODE OF OPERATION

With reference to FIGS. 1–4, the mode of operation is now described. The solenoid system 10 is uniquely configured to mechanically engage with respect to the components. The circuit breaker side plate 12 is a standard component supplied by a manufacturer, such as General Electric. The solenoid 14 is designed to engage into the circuit breaker side plate 12 with the two wires 52 and 54 extending up through the hole 56 in the solenoid 14 and through the geometrically configured hole 26 in the bottom surface 25 of the enclosure 17 and connected to the rectified direct current output of the diodes 40, 42, 44 and 46 at solder terminals 36 and 38. The clamp bracket 16 is configured with a downwardly extending portion (not shown) which extends from the configured hole 26 to engage the hole 56 of the metal casing of the solenoid 14. The mounting tabs 18 and 20 are geometrically designed to engage holes in the circuit breaker side plate 12 for easy securement by bolts or screws. The clamp bracket 16 includes terminal indentations 28 and 30 in the wall 49*d* to receive the bridge diode rectifier assembly 58 supported by two terminals 32 and 34 and with diode solder terminals 36 and 38 between opposing diodes 40 and 46 and opposing diodes 42 and 44. Alternating electrical power connects to the terminals 32 and 34 of the bridge diode rectifier assembly 58 which rectifies the AC to DC which connects to and operates the solenoid 14. This combination of elements provides a uniquely packaged mechanical and electrical solenoid assembly.

Various modifications can be made to the present invention without departing from the apparent scope hereof.

What is claimed is:

1. A clamp bracket for fastening a solenoid to a supporting structure and for housing a diode bridge rectifier assembly to be electrically connected to the solenoid, comprising: a geometrically configured, one-piece body having a top surface and a concave semi-cylindrical bottom surface; mounting tabs extending outwardly from said one-piece body, said mounting tabs being located on opposite sides of said one-piece body and each mounting tab having an upper surface, a planar lower surface, an a hole extending therethrough from said upper surface to said planar lower surface; and an enclosure located directly over said concave semi-cylindrical bottom surface of said one-piece body for housing a diode bridge rectifier assembly, said enclosure comprising walls extending upwardly from said top surface of said one-piece body and formed unitarily with said one-piece body, a bottom surface constituted by said top surface of said one-piece body, and a cover extending over said walls.

2. The clamp bracket as defined in claim 1, wherein a hole extends through said one-piece body from said concave semi-cylindrical bottom surface to the interior of said enclosure.

3. A solenoid system comprising:

a. a solenoid having an outer cylindrical surface;

b. a clamp bracket for fastening the solenoid to a supporting structure, the clamp bracket including:

(1) a top portion including an enclosure;

(2) a bottom portion including a concave semi-cylindrical surface located directly beneath the enclosure and mating with and being in direct physical contact with the outer cylindrical surface of the solenoid; and, (3) mounting tabs for use in attaching the clamp bracket to the supporting structure; and, c. a diode bridge rectifier assembly within the enclosure and electrically connected to the solenoid.

4. The solenoid system as defined in claim 3, wherein the enclosure has an open top and a removable cover for closing the open top.

5. The solenoid system as defined in claim 3, wherein the diode bridge rectifier assembly includes four diodes.

6. The solenoid system as defined in claim 3, further including first and second terminals each having a first end and a second end, the first ends of the first and second terminals residing within the enclosure and being connected to the diode bridge rectifier assembly, and the second ends of the first and second terminals protruding from the enclosure for making external connection.

7. The solenoid system as defined in claim 6, wherein the enclosure includes a removable cover for enabling access to the diode bridge rectifier assembly and to the first ends of the first and second terminals.

8. The solenoid system as defined in claim 3, wherein the enclosure has a bottom wall with a hole therethrough, and wherein the solenoid includes lead wires extending therefrom which pass through the hole in the bottom wall of the enclosure and are connected to the bridge diode rectifier assembly.

* * * * *